US005217384A

United States Patent [19]

Merten et al.

[11] Patent Number: 5,217,384

[45] Date of Patent: Jun. 8, 1993

[54] MECHANICAL LOCKING ON PLUG CONNECTION BETWEEN ELECTRICAL SWITCH AND CONNECTING PLUG

[75] Inventors: Günter Merten, Landrijiet; Pierre Micallef, St.Julians, both of Malta

[73] Assignee: Merit-Elektrik GmbH, Gummersbach, Fed. Rep. of Germany

[21] Appl. No.: 920,252

[22] Filed: Jul. 27, 1992

[30] Foreign Application Priority Data

Jul. 26, 1991 [DE] Fed. Rep. of Germany ..... 4124798

[51] Int. Cl.[5] ..... H01R 13/62

[52] U.S. Cl. ..... 439/304; 439/353; 439/557; 200/295; 200/296

[58] Field of Search ..... 200/294, 295, 296; 248/27.1, 27.3; 439/304, 345, 350, 351, 352, 353, 354, 355, 357, 557

[56] References Cited

U.S. PATENT DOCUMENTS

| | | | |
|---|---|---|---|
| 3,121,854 | 2/1964 | Loesch | 200/296 X |
| 3,790,914 | 2/1974 | Hough | 439/304 X |
| 4,327,264 | 4/1982 | Botz et al. | 200/295 |
| 5,047,604 | 9/1991 | Grass et al. | 200/294 |

FOREIGN PATENT DOCUMENTS

| | | |
|---|---|---|
| 7119295 | 11/1971 | Fed. Rep. of Germany . |
| 2745093 | 10/1977 | Fed. Rep. of Germany . |
| 3015138 | 10/1981 | Fed. Rep. of Germany . |
| 3025480 | 2/1982 | Fed. Rep. of Germany . |
| 3415640 | 10/1984 | Fed. Rep. of Germany . |
| 3444617 | 6/1986 | Fed. Rep. of Germany . |
| 3513591 | 10/1986 | Fed. Rep. of Germany . |
| 8605994 | 8/1987 | Fed. Rep. of Germany . |
| 3825654 | 2/1990 | Fed. Rep. of Germany . |
| 9005667 | 9/1990 | Fed. Rep. of Germany . |

OTHER PUBLICATIONS

SU 9 07 649 Feb. 23, 1982.

*Primary Examiner*—Larry I. Schwartz
*Assistant Examiner*—Khiem Nguyen
*Attorney, Agent, or Firm*—Michael J. Striker

[57] ABSTRACT

A mechanical locking on a plug connection between an electrical switch forming one part and a connecting plug forming another part, comprises a pin-shaped extension provided on one of the parts, a matching depression on another of the parts in which the extension engages, the depression having a side wall extending parallel to a longitudinal axis of the plug connection and provided with an inwardly extending blocking lug, a blocking spring having a pin-shaped extension engageable with the blocking lug and having a blocking extension extending outwardly toward the blocking lug and an inwardly directed blocking extension engageable in a recess which can be brought in alignment with a depression of the pin-shaped extension. A housing of one the connecting plug and the switch and has an engagement slot located adjacent to a free end of the blocking spring and provided for a pin-shaped tool with which the blocking projection can be released from a locking connection with the blocking lug only in such a position of the switch in which the blocking extension of the blocking spring is located opposite to the recess of the pin-shaped extension for a blocking engagement and releaseable from locking with the blocking lug, so that the switch and the connecting plug can be pulled out and withdrawn from one another.

10 Claims, 2 Drawing Sheets

MECHANICAL LOCKING ON PLUG CONNECTION BETWEEN ELECTRICAL SWITCH AND CONNECTING PLUG

BACKGROUND OF THE INVENTION

The present invention relates to a mechanical locking on a plug connection between an electrical switch and a connecting plug with a pin-shaped extension on one of the parts to be connected with one another, which extension engages in a matching recess on the other of the parts.

In order to increase the operational safety and to provide protection from mis-use, it is recommended in electrical plug connections of switches to provide a mechanical locking of the switch with the connecting plug. Such a mechanical locking can however as a rule be released by anyone without special knowledge of the locking function with simple auxiliary means so that practically no protection against mis-use is provided.

SUMMARY OF THE INVENTION

Accordingly, it is an object of the present invention to provide a mechanical locking between an electrical switch and a connecting plug, which avoids the disadvantages of the prior art.

More particularly, it is an object of the present invention to provide a locking connection of the above mentioned type which is formed so that for releasing the locking, knowledge is required which can be obtained only by somebody who knows the subject, or in other words by a person who is authorized for it.

In keeping with these objects and with others which will become apparent hereinafter, one feature of the present invention resides, briefly stated, in a mechanical locking, in which the switch or the connecting plug is provided with a recess having a side wall which extends parallel to the longitudinal axis of the plug connection, and a blocking projection extends from the side wall inwardly for engaging with a blocking spring provided on a pin-shaped extension and having an outwardly extending blocking projection toward the blocking extension and an inwardly extending blocking extension which engages in the releasing position of the blocking spring in a recess which by actuation of the switch can be brought in coincidence with a depression of the pin-shaped extension, and the housing of the connecting plug or the switch has an engaging slot located adjacent to the free end of the blocking spring and provided for a pin-shaped tool such as for example a screwdriver or the like, with which the blocking projection is releasable from the locking position with the blocking extension only in such a position of the switch in which the blocking extension of the blocking spring is located opposite to the recess of the pin-shaped extension for a blocking engagement, so that the switch and the connecting plug can be pulled out and separated from one another.

The mechanical locking between the mechanical switch and the connecting plug in accordance with the present invention has the advantage that the electromechanical connection of the switch and the connecting plug can be performed in any switch condition, the separation of the connection however is possible only in a completely predetermined switch position.

It is especially advantageous that the locking during making the plug connection is performed completely automatically and no additional manipulations are required. For unlocking, a switch position which is known exclusively to an authorized person and also a special tool use is required. The principle of locking can be utilized not only for the switches with rotary movement but with respective adjustment also for switches with linear movement.

An especially robust and reliable locking of the switch and the connecting plug is obtained in accordance with the preferable embodiment of the invention when the extension which extends from the lower part or base of the switch is hollow and cylindrical with a radial recess adjoining the blocking spring, and the switching or turning axle of the switch extends into the cylindrical extension and in the region of the lateral depression on the extension has a lateral groove or flattening as a recess for engaging of the blocking extension extending from the blocking spring in a predetermined switching position in which the recess on the turning axle is brought in alignment with the depression on the cylindrical extension.

An especially reliable locking between the switch and the connecting plug is obtained when the blocking projection has a blocking surface which engages the opposite blocking lug and is directed from the blocking spring perpendicularly outwardly.

The mechanical locking is also facilitated when the blocking lug laterally extending into the depression on the switch or on the connecting plug has an inclined surface raising in the insertion direction of the extension so that the blocking projection slides on it during making the plug connection until its blocking surface engages the parallel abutment surface on the blocking lug. The blocking projection has advantageously an inclined outer sliding surface, with which its slides along the inclined surface of the blocking lug during making the plug connection.

A simple and reliable unlocking of the plug connection is further possible when the blocking spring at its free end is formed with a lateral engagement surface for a tool or a screwdriver, extending laterally over the blocking projection. It is advantageous when the blocking extension extends from the free end of the blocking spring at a distance from the blocking projection to the opposite side of the blocking spring and it is inclined inwardly.

Furthermore the principle of this safety locking can be utilized for switches with linear movement such as displacement, pressure and plunger switches, when the depression for the engagement of the blocking extension located opposite to the blocking projection on the blocking spring is formed on the linearly displaceable part of the switch which is extend opposite to the pin-shaped extension and transverse to the longitudinal axis of the plug connection.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
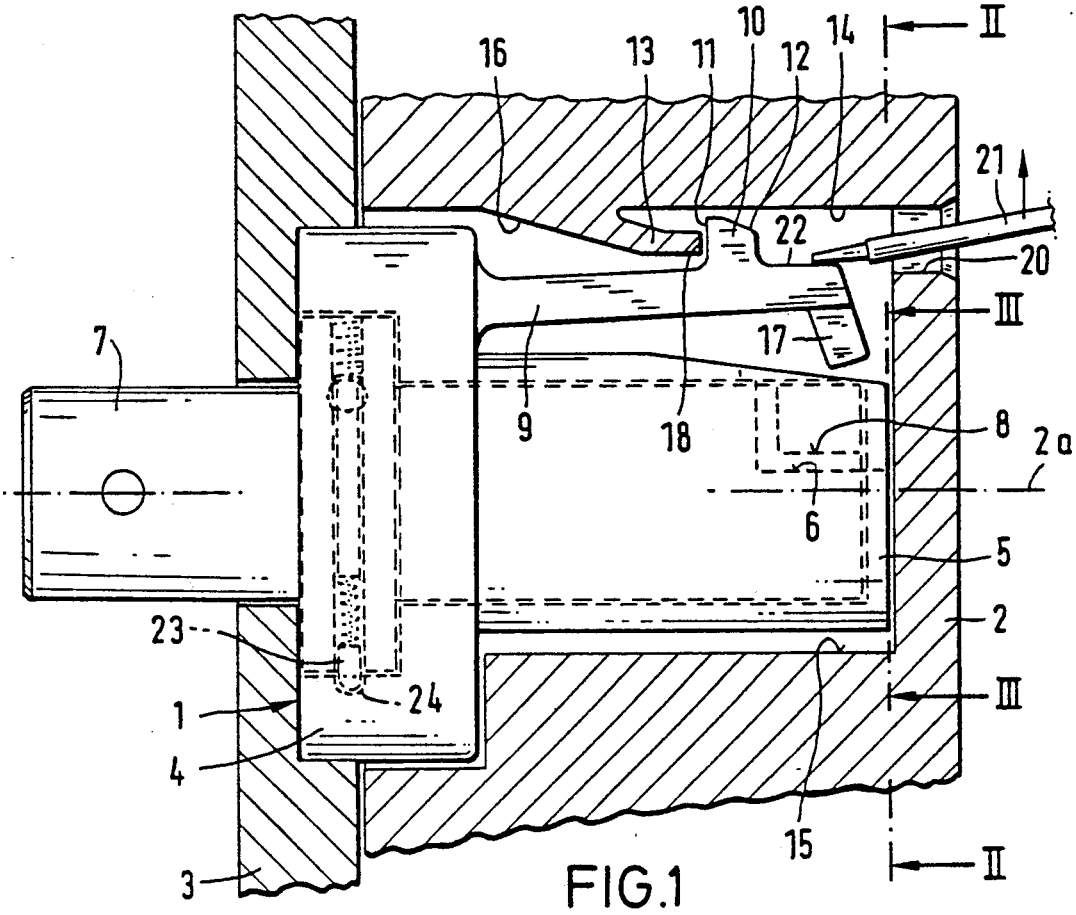
FIG. 1 is a showing a longitudinal section of essential parts of mechanical locking between an electrical switch and a connecting plug.
Figure 2:
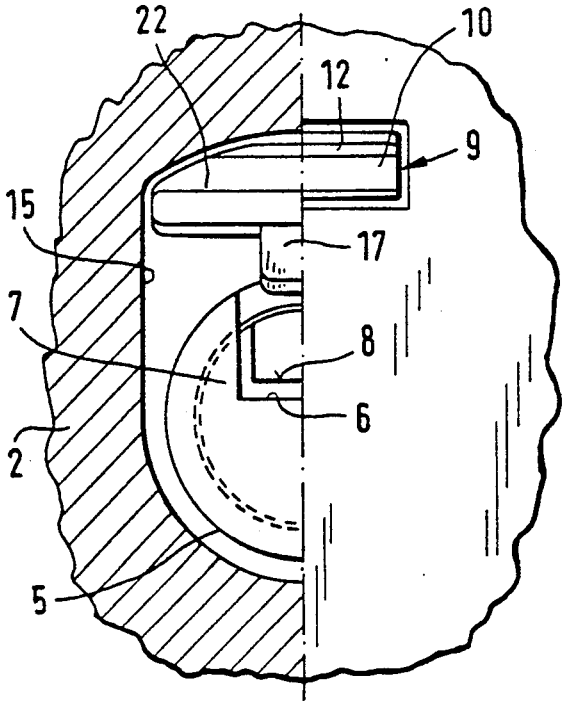
FIG. 2 is a view showing a section through the locking in accordance with the present invention, taken along the line II—II in FIG. 1.
Figure 3A:
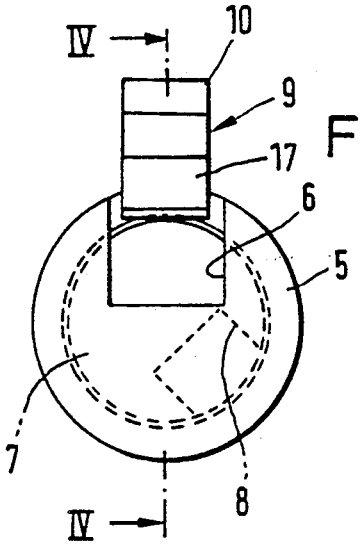
FIGS. 3*a*, 3*b*, 3*c* are views showing a section taken along the line III—III in FIG. 1 in different positions of mechanical locking of the electrical switch and connecting plug.
Figure 3B:
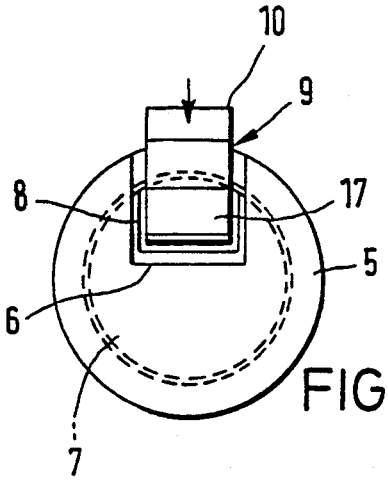
Figure 3C:
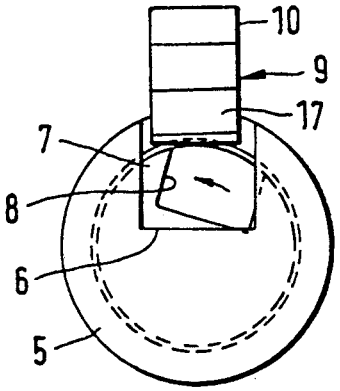

The drawing schematically shows an embodiment of a mechanical locking between an electrical switch 1 and a connecting plug 2. The switch 1 is mounted on a supporting plate 3 and has a lower side or base 4 on which a not shown connecting plug for the electrical plug connection is located. An inwardly hollow cylindrical extension 5 extends from the lower part or base 4 in direction of the longitudinal axis 2*a* of the plug connection and has a lateral depression 6. A turning or switching axle 7 of the switch 1 extends in the cylindrical extension 5 and has a lateral recess 8. The recess 8 is located at a predetermined location and formed as a groove or flattening which can be brought in alignment with the lateral depression 6 on the pin-shaped extension 5 by turning of the turning or switching axle 7 of the switch 1. Instead of such a groove or flattening, the turning or switching axle 7 can be made eccentric at this location.

A blocking spring 9 with a lateral blocking extension 10 is connected with the switch base 4 and extends substantially parallel to the extension 5 and to the longitudinal axis 2*a* of the plug connection. The blocking spring 9 has a blocking surface 11 and an outer inclined sliding surface 12 which slides along a blocking lug 13 during making the plug connection. The blocking lug 13 extends radially inwardly from the housing wall 14 of the connecting plug 2 in a recess 15 for the extension 5. It has an inclined surface 16 which raises in the displacement direction of the switch extension 5.

A blocking extension 17 extends from the free end of the blocking spring 9 at a distance from the blocking projection 10 and to the opposite side of the blocking spring 9 in the region of the recess 6. It is inclined inwardly so that when the lateral groove or flattening 8 on the turning or switching axle 7 is in alignment with the radial depression 6 of the cylindrical extension 5 of the switch 1, it engages in both coinciding depression or groove.

Figure 4A:
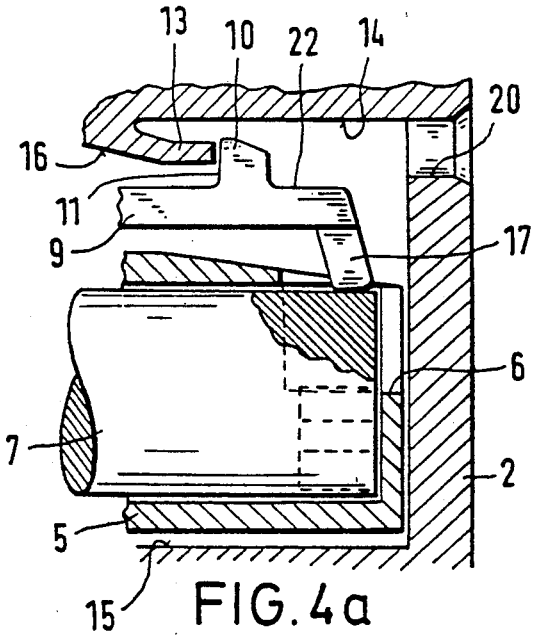
FIG. 4*a* is a partial view of the mechanical locking in accordance with the present invention taken along the line IV—IV in FIG. 3*a* in the locking position.
Figure 4B:
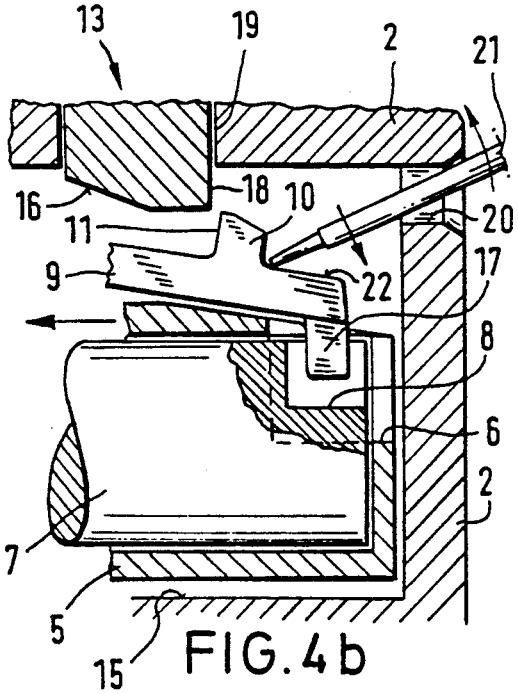
FIG. 4*b* is a partial view substantially corresponding to the view of FIG. 4*a* in a position in which the mechanical locking between the switch and the connecting plug is released by a suitable tool.

As can be seen from the section views shown in FIG. 1, FIG. 4*a* and FIG. 4*b* the blocking lug 13 which extends in the depression 15 provided on the connecting plug 2 for the extension 5 of the switch 1, has a rearwardly inclined abutment surface 18 for the vertically outwardly directed blocking surface 11 on the blocking projection 10 at the side of the blocking spring. The blocking lug 13 is arranged on the housing wall 14 of the switch 1 which extends parallel to the longitudinal axis 2*a* of the plug connection and to the not shown coupling plugs of the connection plug 2, or on the depression 15 of the connecting plug. It has an inclined surface 16 raising in an insertion direction of the pin-shaped extension 5 and provided for the blocking extension. The blocking projection 10 slides on it during making the plug connection and is deviated until it engages with its perpendicular vertical blocking surface 11 behind the parallel abutment surface 18 of the blocking lug 13. The blocking lug 13, as shown in FIG. 1 and FIG. 4*a*, can be formed springy at its free end.

The connecting plug 2 also has on a housing with an engagement slot 20 a for pin-shaped tool 21, such as a screwdriver or the like. Therefore, as shown in FIG. 1, the radially outwardly extending blocking projection 10 can be disengaged from the blocking lug 13 by pressing down of the blocking spring 9. This is possible only in a predetermined position of the switch 1 in which the blocking extension 17 of the blocking spring 9 can engage in the depression 6 on the pin-shaped extension 5 and in the aligned groove or flattening 8 on the switching axle 7, so that the blocking spring 9 can be released from locking with the blocking lug 13 in FIGS. 1 and 4*a*, and the switch and the connecting plug 2 can be separated from one another.

The connection of the connecting plug 2 with the base or lower part 4 of the schematically shown switch 1 can be formed in each switching position when the blocking lug 13 associated with the blocking projection 10 on the blocking spring 9 is formed at its free end springy and radially displaceable as shown in the embodiment of FIG. 4*b*, so that during insertion of the extension 5 with the blocking spring 9 it is deviated by the inclined surface 12 on the blocking projection 10. After making the plug connection the blocking surface 11 of the blocking projection 10 engages behind the abutment surface 18 on the blocking lug 13, and the switch 1 and the connecting plug 12 are reliably locked.

When the locking must be released, the switch 1 must be first brought into a position in which the groove or flattening 8 on the switching axle 7 projects over the blocking extension 17 on the end of the blocking spring 9.

When this position is reached, the blocking projection 10 can be released from the engagement with the blocking lug 13. This can be achieved by pressing down of the blocking spring 9 with a pin-shaped tool 21 such as for example a screwdriver or the like, which extends through the engagement slot 20 or the engagement opening in the plug housing and comes to abutment either against a lateral engagement surface 22 on the free end of the blocking spring 9 or on the outwardly located sliding surface 12 of the blocking projection 10. The blocking spring 9 is moved therefore by the screwdriver in direction to the aligned depression 6 on the extension 5 and the groove or flattening 8 on the switch axle 7 to the center until the blocking surface 11 on the blocking projection 10 is released from the abutment surface 18 on the blocking lug 13, and the connecting plug 2 can be withdrawn from the switch 1.

Instead of switch 1, the blocking spring 9 in accordance with a different embodiment of the invention can project inwardly also from the connection plug 2. Then the blocking lug 13 for the engagement with the blocking projection 10 must be formed on the switch 1 while the depression 6 on the extension 5 and the groove or flattening 8 on the turning axle 7 of the switch 1 must be arranged so that they can be brought in opposite engagement with the blocking extension 17 of the blocking spring 9 for releasing the locking. Correspondingly, the engagement slot 20 or the engagement opening for the screwdriver must be arranged instead of the connection plug 2, on the housing of the switch for releasing the locking between the inwardly plugged parts of the switch 1 and the connection plug 2.

The principle of this safety locking can be used not only for the switches with a turning movement, but after corresponding adjustment also for switches with linear movement as well. Then the depression 6 for engaging the blocking extension 17 opposite to the blocking projection 10 of the blocking spring 9 must be formed on a linearly displaceable part of the switch 1 which with respect to the pin-shaped extension 5 extends transversely to the longitudinal axis 2*a* of the plug connection.

It will be understood that each of the elements described above, or two or more together, may also find a useful application in other types of constructions differing from the types described above.

While the invention has been illustrated and described as embodied in a mechanical locking connection on a plug connection between an electrical switch and a connection plug, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A mechanical locking on a plug connection between an electrical switch forming one part and a connecting plug forming another part, the mechanical locking comprising a pin-shaped extension provided on one of said parts; a matching depression on another of said parts in which said extension engages, said depression having a side wall extending parallel to a longitudinal axis of the plug connection and provided with an inwardly extending blocking lug; a blocking spring having a pin-shaped extension engageable with said blocking lug and having a blocking projection extending outwardly toward said blocking lug and an inwardly directed blocking extension engageable in a recess which can be brought in alignment with a depression of said pin-shaped extension; a housing of one said connecting plug and said switch and having an engagement slot located adjacent to a free end of said blocking spring and provided for a pin-shaped tool with which said blocking projection can be released from a locking connection with said blocking lug only in such a position of said switch in which said blocking extension of the blocking spring is located opposite to said recess of said pin-shaped extension for a blocking engagement and releasable from locking with said blocking lug, so that said switch and said connecting plug can be pulled out and withdrawn from one another.

2. A mechanical locking as defined in claim 1, wherein said switch has a lower part provided with said extension, said extension being hollow and cylindrical and formed with said depression located adjacent to said blocking spring, said switch having a switch axle extending into said extension and provided in the region of said depression on said extension with a lateral formation formed as said recess for engagement of said blocking extension extending from said blocking spring in a predetermined switching position in which said recess of said turning axle is aligned with said depression of said cylindrical extension.

3. A mechanical locking as defined in claim 2, wherein said formation is formed as a lateral groove.

4. A mechanical locking as defined in claim 2, wherein said formation is formed as a flattening.

5. A mechanical locking as defined in claim 1, wherein said blocking projection has an outwardly directed blocking surface which extends perpendicularly outwardly from said blocking spring and engages behind said blocking lug.

6. A mechanical locking as defined in claim 5, wherein said blocking lug has an abutment surface, said blocking lug extending laterally in said depression and having an inclined surface which raises in an insertion direction of said extension and so that said blocking projection slides on it during making the plug connection until said blocking surface blockingly engages said abutment surface.

7. A mechanical locking as defined in claim 6, wherein said blocking projection has an inclined outer sliding surface which slides along said inclined surface of said blocking lug during making the plug connection.

8. A mechanical locking as defined in claim 1, wherein said blocking spring has a free end provided with a lateral engagement surface which extends over said blocking projection and is formed for engaging by a tool.

9. A mechanical locking as defined in claim 1, wherein said blocking extension extends inwardly inclined from a free end of said blocking spring at a distance from said blocking projection to an opposite side of said blocking spring.

10. A mechanical locking as defined in claim 1, wherein said depression for engaging said blocking extension located opposite to said blocking projection on said blocking spring is formed on a linearly displaceable part of said switch located opposite to said pin-shaped extension transversely to a longitudinal axis of the plug connection.

* * * * *